United States Patent [19]

Wagner

[11] 4,156,747

[45] * May 29, 1979

[54] PROCESS FOR FLAME RETARDING CELLULOSICS

[75] Inventor: George M. Wagner, Lewiston, N.Y.

[73] Assignee: Hooker Chemicals & Plastics Corp., Niagara Falls, N.Y.

[ * ] Notice: The portion of the term of this patent subsequent to Jan. 10, 1995, has been disclaimed.

[21] Appl. No.: 852,999

[22] Filed: Nov. 18, 1977

Related U.S. Application Data

[60] Continuation-in-part of Ser. No. 628,678, Nov. 3, 1975, Pat. No. 4,068,026, which is a continuation-in-part of Ser. No. 493,815, Aug. 1, 1974, Pat. No. 3,933,122, which is a division of Ser. No. 244,574, Apr. 11, 1972, Pat. No. 3,846,166.

[51] Int. Cl.[2] ..... C09K 3/28; B05D 3/04

[52] U.S. Cl. ..... 427/341; 427/342; 427/353; 427/354; 427/389; 427/390 D; 428/921

[58] Field of Search ..... 427/341, 342, 390 D, 427/353, 354; 428/921

[56] References Cited

U.S. PATENT DOCUMENTS

| | | | |
|---|---|---|---|
| 3,310,419 | 3/1967 | Wagner | 427/341 |
| 3,607,356 | 9/1971 | Beninate et al. | 427/341 |
| 3,784,356 | 1/1974 | Wagner | 427/390 D |
| 3,903,336 | 9/1975 | Nachbur et al. | 427/390 D |
| 3,953,165 | 4/1976 | Pepperman et al. | 427/390 D |
| 4,068,026 | 1/1978 | Wagner | 427/341 |

*Primary Examiner*—John D. Smith

*Attorney, Agent, or Firm*—Peter F. Casella; William J. Crossetta, Jr.

[57] ABSTRACT

An improved process for imparting durable flame retardancy to textile materials wherein said material is impregnated with a solution having a poly(hydroxyorgano) phosphonium cation content of from about 10 to about 60 percent by weight and having a pH of from about 2 to about 9, dried to a moisture content of from about 0 to about 8 percent, aerated by passing air through the dried material, cured by polymerizing the monomer on and in the cellulose material with exposure in an enclosed chamber to an atmosphere containing gaseous ammonia and thereafter contacting with water, the improvement comprising, impregnating said textile materials with a nitrogen containing material, contiguous with impregnation with the poly(hydroxyorgano) phosphonium cation containing solution, and, after contacting said material with said water, further exposing said material to an atmosphere containing gaseous ammonia.

25 Claims, 1 Drawing Figure

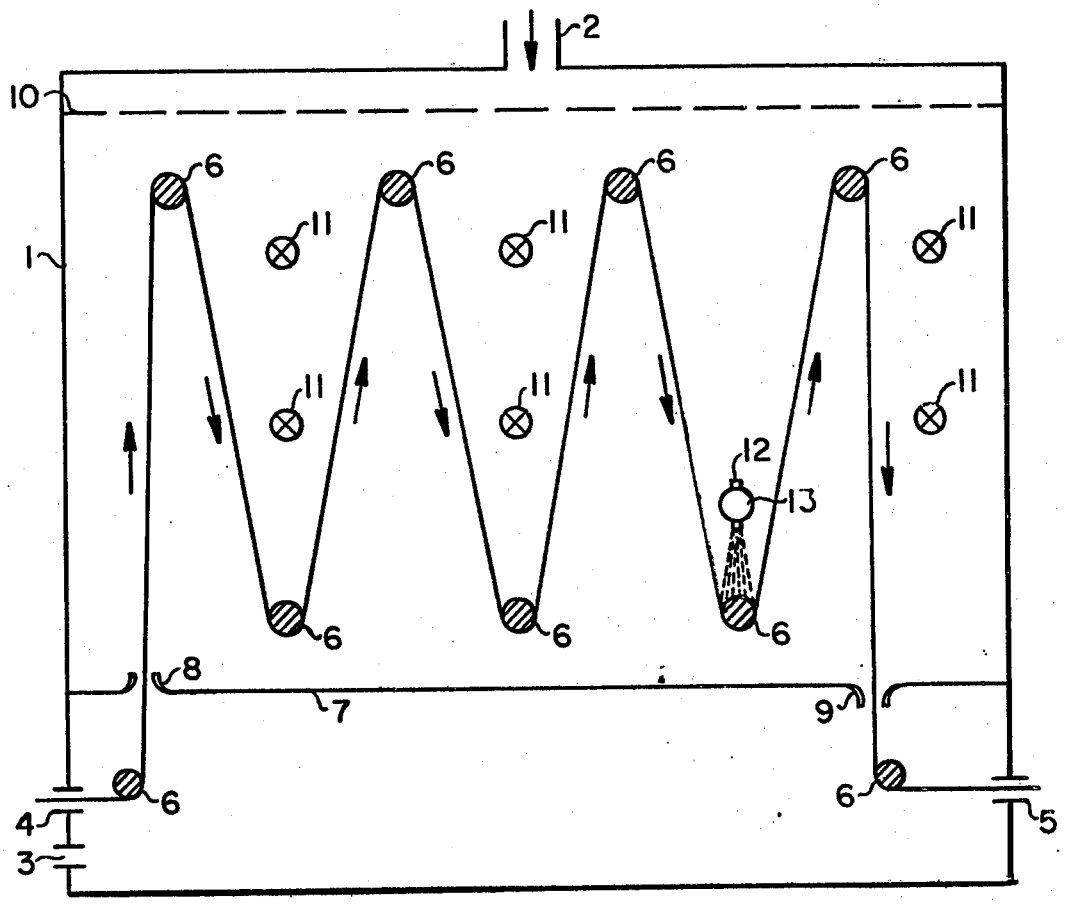
2
10
1
6
11
12
13
8
7
9
4
3
5

PROCESS FOR FLAME RETARDING CELLULOSICS

This application is a continuation-in-part of copending application Ser. No. 628,678, filed Nov. 3, 1975 now U.S. Pat. No. 4,068,026 issued Jan. 10, 1978 which in turn is a continuation-in-part of Ser. No. 493,815, filed Aug. 1, 1974 now U.S. Pat. No. 3,933,122 issued Jan. 20, 1976 which in turn is a divisional application of Ser. No. 244,574 filed Apr. 17, 1972 now U.S. Pat. No. 3,846,166.

FIELD OF INVENTION

This invention relates to an improved process for rendering textile materials flame retardant. More particularly, it relates to a rapid and hence more practical process for polymerizing (hydroxyorgano) phosphonium cation and nitrogen containing compounds on and in cellulose-containing materials with ammonia to render them durably flame retardant.

BACKGROUND OF THE INVENTION

In U.S. Pat. No. 3,607,356, it has been proposed to impregnate cellulose-containing materials with an aqueous solution containing an equilibrium mixture of tris(-hydroxymethyl) phosphine ("THP") and tetrakis (hydroxymethyl) phosphonium hydroxide ("THPOH") said solution having a pH of about 7 to about 8. In this process, the impregnated material containing from 10 to about 40 percent by weight of the monomer is dried to about 10 to about 20 percent moisture and then treated with gaseous ammonia in an enclosed cabinet to polymerize the resin monomer. The gaseous ammonia treatment step requires from one or two to 6 minutes exposure time depending upon the character, i.e., the weight, fibrous nature, etc. of the treated material. In many textile processs, the materials are processed in equipment operating at high speed in a continuous manner. Accordingly, operations involving processing times of several minutes duration require either static operation or units of a size wherein each relatively long residence times can be obtained. It is, therefore, desired to process such materials in equipment wherein shorter residence times consistent with high speed continuous operations can be obtained in a practical manner. Moreover, the treatment according to the process of U.S. Pat. No. 3,607,356, when used with available ammonia treatment cabinets, has been found to produce finishes on cellulosic materials which often tended to dust and the durability of the finished materials often failed to meet the stringent government standards (Department of Commerce Standard FF-3-71) which require that the treated materials withstand at least fifty home washing and drying cycles. The enclosed chamber for carrying out the ammonia treatment commonly used in this field comprises a series of perforated pipes housed in a box like enclosure having a large opening in the top. The partially dried impregnated material is passed over the perforated pipes through which ammonis gas is forced. The excess ammonia gas is vented through the opening in the top of the enclosure, and discharged into the atmosphere. This venting of considerable quantities of ammonia gives rise to a severe pollution problem. It can thus be seen that the process disclosed in U.S. Pat. No. 3,607,356 not only results in a highly inefficient utilization of ammonia but also is hardly practical for the lighter, open weave, materials and leaves much to be desired when processing heavier and/or close knit materials.

It is known also, as disclosed in U.S. Pat. No. 2,983,623, to cure further polymerizable methylol-phosphorus polymeric material containing at least one free methylol group attached to a phosphorus atom incorporated in a cellulosic material, by exposing said material in the dry state to the action of gaseous ammonia followed by subjecting it to an aqueous ammonia treatment. In this process, the further polymerizable resins disclosed are solutions of reaction products of tetrakis(-hydroxymethyl) phosphonium chloride and urea which solutions are relatively strongly acid and are applied in the presence of buffers which adjust the pH of the solutions to a pH within the range of about 3.5 to 4. The impregnated material is thoroughly dried, exposed to ammonia gas for about 5 to 10 or more minutes, and then immersed in aqueous ammonia for about 10 or more minutes to complete the cure of the resin on and in the material. Such a process also requires relatively long time cycles of treatment especially in the aqueous ammonia hence is hardly applicable with modern high speed processing techniques.

The problem of the long time cycles and efficiency of the polymerization has been substantially overcome by the apparatus and process disclosed in U.S. Pat. No. 3,933,122 issued Jan. 20, 1976. In this application an apparatus and process for imparting flame retardance to cellulose containing materials is disclosed whereby materials which have been impregnated with a solution having a pH of from about 7 to about 9 and a tetrakis (hydroxymethyl) phosphonium hydroxide content of from about 0 to about 8 percent and the monomer is polymerized in and on the cellulose material by exposure in an enclosed chamber to an atmosphere containing from about 50 to about 90 percent by volume of gaseous ammonia for about 5 to about 30 seconds. By this process and with this apparatus the monomer is rapidly and effectively polymerized on and in the cellulose containing material, thereby imparting durable flame retardance to the materials in a rapid and efficient manner. Under certain mill conditions it was found that substantial amounts of formaldehyde was formed during the gaseous ammonia exposure step and when the cured fabric was batched in rolls or on trucks immediately upon exit from the ammonia chamber, it was noted that the odor of formaldehyde rapidly developed in the batched processed materials and also that a considerable exotherm was prevalent in the material. In such materials, i.e., when the odor of formaldehyde and/or exotherm was noted, the durability of the flame retardant character was reduced. It is believed that the formaldehyde produced by decomposition of the polymerized or partially polymerized monomer when confined in the material, reacted with the polymer or partially polymerized polymer to form a moisture sensitive reaction product which may deleteriously affect the durable character of the flame retardant treatment.

The process of the present invention represents an improvement over the process of the aforementioned U.S. Pat. No. 3,933,122 whereby the deleterious effect of the action of formaldehyde is obviated and thus a rapid and effective means of imparting durable flame retardance to cellulose containing materials is provided. Further said improved process is more generally applicable with the currently used high speed textile processing equipment and conditions.

OBJECTS OF THE INVENTION

It is, therefore, a principal object of the present invention to provide an improved process for treating textile materials to render them durably flame retardant.

Another object is to provide a more rapid process for imparting flame retardant characteristics to textile materials whereby said materials are impregnated with a solution containing poly (hydroxyorgano) phosphonium cation and a nitrogen containing material, dried to remove substantially all of the retained moisture and rapidly and efficiently cured by gaseous ammonia.

A particular object is to provide a process which does not require, in the curing step, prolonged exposure of the impregnated material to either large excesses of gaseous ammonia or aqueous ammonia or both.

A further object is to provide a process which allows operation at low pH, thereby substantially reducing the amount of formaldehyde produced during the process.

An additional object is to provide a process whereby the deleterious effect of polymer degradation products on the treated material is substantially prevented.

A further additional object is to obviate the need for precondensed materials of the prior art while producing a more acceptable "hand".

These and other objects will be apparent to those skilled in the art by the following description of the present invention.

SUMMARY OF THE INVENTION

It has now been found that textile materials can be rapidly and economically rendered durably flame retardant by a process which comprises:

a. Impregnating a textile material with a poly (hydroxyorgano) phosphonium cation containing solution, having a pH of from about 2 to about 9, containing from about 10 to about 40 percent by weight of poly(hydroxyorgano) phosphonium cation, and contiguously therewith impregnating said textile material with a nitrogen containing compound;

b. Drying the impregnated material, preferably under relatively mild conditions, to a moisture content of from about 0 to about 8 percent by weight;

c. Aerating the dried material by directing a current of air through the dried material;

d. Exposing the aerated material in an enclosed chamber for a period of at least about 5 seconds but less than about 60 seconds to an atmosphere containing at least about 50 percent by volume of gaseous ammonia to cure the phosphorus containing resin in and on the material;

e. Contacting the material with water to render the material durably flame retardant.

In addition it has been found to be effective to further expose the water contacted material for a period of from about 1 to about 10 seconds to an atmosphere containing at least about 50 percent by volume of gaseous ammonia.

The curing steps (d) and (e) of the new process may be carried out in an enclosed cabinet which comprises:

a housing;

gas inlet means disposed in the upper portion of said housing;

gas outlet means disposed in the lower portion of said housing;

material inlet means and material outlet means disposed in the lower portion of said housing above said gas outlet means;

partition means disposed in said housing between said gas inlet means and said gas outlet means so as to form a gas treatment chamber in the upper portion of said housing, said partition means including means for permitting the introduction into or removal from said gas treatment chamber of textile material to be treated in said chamber while minimizing the passage of gas into and from said gas treatment chamber;

water inlet means with connecting application means disposed in the upper portion of said housing;

water outlet means disposed in the lower portion of said housing below said outlet means; and means disposed in said gas treatment chamber for supporting textile material to be treated. Cabinets of similar design are disclosed in U.S. Pat. No. 3,933,122 issued Jan. 20, 1976.

The ammonia treated material obtained in accordance with the present invention may be washed and dried numerous times without substantial loss of fire retardancy. In addition, there is an increase in the flame retardant efficiency of the process, together with a decrease of formaldehyde odor from the processing equipment and a more acceptable hand than that of prior art condensation type finishes.

DETAILED DESCRIPTION OF THE INVENTION

In accordance with a preferred mode of carrying out the improved process of this invention, an aqueous solution containing from about 10 to about 40 percent by weight of poly(hydroxyorgano) phosphonium cation is prepared and used to impregnate a textile material, the material is also impregnated contiguously with an aqueous nitrogen material containing solution containing about 0.2 to about 1.0 moles of nitrogen containing material per mole of poly(hydroxyorgano) phosphonium cation. The impregnated material is dried to about 0 to about 8 percent moisture, the dried material is aerated substantially immediately after leaving the drier by directing a current of air through the material, preferably suction, said material is then exposed for at least about 5 to less than about 60 seconds and preferably for about 10 to about 30 seconds to an atmosphere containing at least about 50 percent by volume of ammonia, preferably from about 70 to about 95 percent of gaseous ammonia, and the material is contacted substantially immediately after ammonia treatment with water, in an amount sufficient to provide a wet pick-up of from about 10 to about 40 percent by weight of water. The material may be again contacted with the gaseous ammonia atmosphere for a short period of time, from about 1 to about 10 sconds, and preferably from about 1 to about 6 seconds, to further enhance cure. The thus treated material, containing an insoluble polymer of the phosphonium/nitrogen material compound in and on the material, is scoured, washed, and dried.

The treatment of the dried impregnated material with ammonia, i.e., the curing step, is carried out in an enclosed chamber wherein the impregnated material is exposed to a gaseous atmosphere containing a high concentration, i.e., above about 50 percent by volume, of ammonia. The material is preferably passed into and out of the chamber, in a continuous manner and at a relatively high speed, so that the material is exposed to the ammonia atmosphere for at least 5 seconds and preferably from about 15 to about 30 seconds.

The improved process of this invention differs significantly from the processes disclosed in the prior art. In the instant process, non-reacted flame retarding compounds are contacted with the textile material so as to provide in-situ interreaction of the chemicals in the intimate presence of the material. Accordingly, reaction of the flame retarding compounds will occur in and about all the interstitial spaces of the material which have been impregnated with said compounds so as to maximize the flame retarding effect. The material after being dried is aerated by directing a current of air through the dried material, and also the material, after passing through ammonia curing, is exposed to or contacted by water, while in or outside the cabinet, and thereafter may be exposed to ammonia gas again. By conducting the process in this manner, the problems caused by the presence of formaldehyde in the dried uncured impregnated material in the curing step and also after the curing of the monomer on and in the cellulosic material can be substantially obviated. It has been found that the pH of the process may be reduced during curing, resulting in the formation of very little formaldehyde and significantly decreasing the formaldehyde odor, which can be sensed in the plant environment outside the ammoniating chamber. In unexpected addition, a higher efficiency of flame retardancy is achieved when the material is a blend of varying cellulosic materials. By the latter, it is meant that a higher add-on of resin occurs resulting in an increase of flame retarding effect together with increased durability, each without adverse effect to the hand of the material.

The materials which can be treated to impart flame retardant properties thereto in accordance with this invention include cotton, rayon, paper, jute, ramie, wood, and mixtures thereof, as well as blends of cellulosics such as cotton or rayon with synthetic fibers, such as polyesters, nylons, acrylics, acetate and mixtures thereof or with proteinaceous fibers such as wool, silk, mohair, alpaca, mixtures thereof and the like. The process of this invention is particularly effective when applied to the treatment of cellulosic and cellulosic-blend materials such as cotton and rayon with synthetic materials.

The poly(hydroxyorgano) phosphonium cation solution used to impregnate the textile material comprises poly(hydroxyorgano) phosphonium cation or poly(hydroxyorgano) phosphine and poly(hydroxyorgano) phosphonium cation as an equilibrium mixture. Such solutions are well known in the art. One method of preparation is by reacting a solution of tetrakis (hydroxyorgano) phosphonium salt with up to an equivalent quantity of an organic or inorganic base. Typically, any of the tetrakis (hydroxyorgano) phosphonium salts can be utilized to make the solutions of this process. Common salts which may be employed include, for example, the halides, sulfates, acetates, phosphates, carboxylates, oxalates, lactates, formates, sulfonates, and nitrates. The most often used salts are, however, the halides and the sulfates, the preferred being the tetrakis(hydroxyorgano) phosphonium sulfate.

The solvent may be water or an appropriate non-aqueous solvent such as alcohol, N,N-dimethyl formamide, dimethyl acetamide, and mixtures thereof and the like. Alternatively, the solution may be in the form of an emulsion.

The nitrogen containing material may be any appropriate nitrogen containing material such as ammonia ureas, guanidines, substituted ureas, melamines, or other amino or amido function containing organic materials or the partial reaction product of the previously mentioned nitrogen containing materials with aldehydes, preferably formaldehyde. It may be in solution with an appropriate solvent or may be undiluted. The nitrogen containing material is applied contiguously with the phosphonium cation to the textile material which means that it may be applied to the textile material before, during or after the application of the phosphonium cation. When the nitrogen containing material is added before or after the phosphonium cation, it normally is contained in solution with an appropriate solvent such as water or the afore-described non-aqueous solvents utilized with the phosphonium cation. When the nitrogen containing material is added during impregnation of the textile material with phosphonium cation, it need not be in solution. The nitrogen containing material may also be applied in the gaseous state to the textile material. Generally, about 0.2 to about 1.0 moles of nitrogen containing material are used per mole of phosphonium cation, it is preferred however to use about 0.3 to about 0.6 mole per mole of cation.

Generally, a base, must be reacted with the phosphonium salt prior to the application of the phosphonium salt to the textile material to adjust the pH of the phosphonium solution. Especially preferred bases for reaction with the salt are alkaline metal hydroxides, alkaline earth hydroxides, salts of weak acids and strong bases, monoalkaline metal salts of dibasic acids, organic tertiary amines such as triethylamine, trimethylamine, and the like. The pH of the final solution is adjusted to from about 2 to about 9, preferably to from about 4.0 to about 8.1 and most preferably from about 4.5 to about 7.5.

A basic catalyst agent, which also assists the reaction between the phosphonium salts of the present invention and the textile material, may also be utilized. Preferably, the catalyst agent may be applied in a separate step either before, after, or during the application of the phosphonium salt of the present invention.

Basic catalysts which may be employed include, for example, alkali metal or other suitable carbonates, bicarbonates, acetates, phosphates, metasilicates and the like. Particularly suitable catalyst materials have been found to be sodium carbonate, sodium bicarbonate, potassium carbonate, potassium bicarbonate and the monosodium, disodium and trisodium phosphates. Where these materials are added to the textile treating solution, they are preferably present in amounts within the range of about 0.5 to about 20% by weight of the composition.

The treating solution may be applied to the textile in any convenient manner. For example, the solution may be applied by padding, dipping, spraying, and the like. After impregnation, the excess solution is preferably removed from the material by passing the material through squeeze rolls, centrifuging, wringing, or other methods. Although a wet pick-up of from about 50 to about 200 percent may suitably be used, preferably the material contains about an equal weight, i.e., about 100 percent pick-up, of the treating solutions.

The impregnated material is then dried to a residual content of about 0 to about 8 percent and preferably from about 0 to about 3 percent. The drying is carried out in air or in drying oven at temperatures which may vary from ambient to about 125° centigrade. Excessive drying temperatures and times are to be avoided. The drying time may vary according to the drying temperature and also the weight and fibrous nature of the material, as will be obvious to those skilled in this art. The solvent content of the material may be measured by a suitable meter.

The dried material is then aerated by passing a current of air through the material as soon as possible or convenient after leaving the drier. The aeration step can be carried out by passing the material, after drying, over a perforated plate or pipe through which a strong current of air is continuously blown or sucked. Preferably, the air current is moved by suction. Conveniently, this aeration means is located as close as possible and/or convenient to the material exit of the drier. The material is passed over the perforated or slotted air distribution means, a plate, pipes, or series of pipes extending over the width of the fabric and a current of air, flowing at about 1000 to 3000 cubic feet per minute, is caused to pass through the material. The time required for this operation is not critical, and, in general, the material is exposed to the current of air for about 0.5 to about 2.0 seconds or more. As will be apparent, the speed of the material running through the processing equipment will determine the exposure time, and is a function of the volume of air and speed of the material. By this means, any formaldehyde present in the dried material is rapidly removed by the current of air and also the material is rapidly cooled thereby reducing the formation of additional formaldehyde occaisioned by the probable decomposition of the phosphonium compounds.

The aerated impregnated material next is exposed to gaseous ammonia in an enclosed chamber wherein the resin monomer reacts rapidly and substantially completely to form an insoluble polymer within the material. The gaseous atmosphere which comprises at least about 50 percent of gaseous ammonia, and preferably from about 70 to about 95 percent or more of gaseous ammonia provides an effective, efficient, and suprisingly rapid reactant for the resin curing step. It has been found that the curing step is completed, under these conditions, in less than about 60 seconds and generally less than about 45 second, and as low as 5 seconds; whereas, in prior art procedures from about 1 to about 6 minutes were required for substantially complete polymerization and curing of the impregnated composition. Under optimum conditions, the procedure of this invention proceeds with the efficient utilization of the gaseous ammonia charged to the process, whereas prior art processes often preferred up to a 15 fold excess of the ammonia reactant. This huge excess of ammonia presented a serious air pollution problem, which in the present process and apparatus has been eliminated by the highly efficient utilization of the ammonia.

BRIEF DESCRIPTION OF THE DRAWING

A particularly effective, and hence preferred, apparatus for carrying out the curing step of this process is illustrated by the FIGURE which shows a schematic view of the enclosed cabinet apparatus of this invention.

DETAILED DESCRIPTION OF THE DRAWING

In this drawing the housing, 1, contains a gas inlet, 2, and a gas outlet, 3, which is conviently connected to a suction means, not shown. The housing is provided also with a material inlet, 4, and material outlet, 5, for admitting the dried impregnated material and exiting the cured material. Material guides, 6, are provided for conveying the impregnated material through the cabinet. Partitioning means, 7, extending across the interior of the housing serves to form a chamber in which the material is contacted with the gas. The partitioning means includes flaps, 8 and 9, which permits the material to be treated to enter the gas treatment chamber and the treated material to exit from said chamber, while minimizing the passage of gas into and from the said chamber. A gas distribution device, shown here as a perforated plate, 10, is provided to assist in the distribution of the entering gas stream evenly throughout the gas treatment chamber. Sensing ports, 11, are provided in the gas treatment chamber for removal of samples of the gaseous atmosphere for analysis to monitor the concentration of the treatment gas. Water inlet means, 12, with connecting application means, 13, are provided in the gas treatment chamber for the water treatment step.

The housing may be provided with cooling means, not shown, to cool the treatment chamber and to regulate the temperature of the gaseous atmosphere within the treatment chamber. A liquid condensate discharge port, not shown, may be positioned at a convenient place in the housing for removal of condensate from the chamber. Such port should be at a lower point than the material inlet or outlet and the gas outlet, 3.

The housing can be fabricated from conventional materials of construction such as wood, metal, glass, plastic, and the like or any combination thereof.

The partition means 7, may be constructed from like materials or from rubber. The flaps, 8 and 9, are fabricated from flexible materials such as rubber, leather, plastic film and are attached to the partition means in any convenient manner. It is important that the flaps do not impede the passage of the material therethrough but do substantially prevent the free flow of gas into and out of the treatment chamber.

In operating this apparatus, ammonia gas is fed into the unit through gas inlet, 1, at a rate sufficient to provide an ammonia atmosphere within the gas treatment chamber having at least about 50 percent by volume of ammonia, and preferably from about 70 percent to about 90 percent ammonia by volume. Textile material which has been impregnated with the poly (hydroxyorgano)phosphonium cation and dried to contain from about 0 to about 8 percent moisture is admitted to the apparatus, preferably in a continuous manner, at inlet, 4, and is passed over material guides, 6, through partitioning means, 7, through flap, 8, into the gas treatment chamber wherein the impregnated material is exposed to the ammonia atmosphere. After exposure to the ammonia atmosphere for the requisite time, it is water treated with water application means 13. The material is again exposed to the ammonia atmosphere and thereafter leaves the gas treatment chamber passing through flap, 9, of partitioning means, 7, and exits from the housing, 1, at material outlet, 5. The passage of air into the gas treatment chamber is minimized in part by the partitioning means and in part by the withdrawal of gas from the housing through gas outlet, 3, which is connected to a mild suction means e.g., a vacuum pump.

The rate of flow of ammonia gas into the apparatus is adjusted to provide at least one mol of ammonia per mole of poly(hydroxyorgano) phosphonium cation available for reaction, i.e., curing, on the impregnated material, Preferably about a 20 percent molar excess of ammonia is supplied. This amount of ammonia can be approximated by the following calculation:

$$\frac{\text{Lbs. of impregnated material}}{\text{Yard of material}} \times \frac{\text{Yds.}}{\text{Min.}} \times \frac{\text{\% cation}}{100} \times \frac{\text{\% Wet pick-up}}{100} \times \frac{1}{172} = \text{Mols of cation/min.}$$

$$\frac{\text{Mols cation}}{\text{min.}} \times \frac{359\ \text{ft.}^3}{\text{mol.}} \times 1.2 = \text{cu. ft. } NH_3 \text{ gas/min.}$$

The material is preferably contacted with water within the enclosed chamber. Any convenient method of water application means may be utilized, such as a trough, stream, spray, etc., or any combination thereof, and any convenient location within the chamber would be appropriate; for example, referring to the drawing, a trough may be located above or below the partitioning means or may be an integral portion thereof through which the material is guided with or without an additional material guiding means. In a like manner, a stream or, as illustrated in the drawing, a spray may also be utilized. A combination of means may also be used in application of the water treatment. A preferred method, however, is the application of water in the form of a fine spray. Several means for accomplishing this step will be obvious to those skilled in this art. For example, a spray head or several heads may be positioned convenient to the material exit means from the curing cabinet. Most preferably, the spraying means is one or several air atomizing water spray heads which are used to supply the water in the form of an atomized spray to the material before exiting from the ammonia curing cabinet. Sufficient water should be added to the material to provide a pick-up of about 10 to about 60 percent by weight and preferably from about 20 to about 30 percent by weight pick-up of water. This water not only cools the hot material but also results in the immobilization of formaldehyde and, thus, prevents its further reaction with the phosphonium salt polymer.

It is believed that the water supplied at this stage of the process provides a reaction medium for the formaldehyde to react with ammonia which may be present to form hexamethylene tetramine, which latter product does not react with the phosphonium salt polymer present in and on the material.

It has been found that further treatment with gaseous ammonia, after contact with water, has a further beneficial effect upon the polymerized material. Treatment with gaseous ammonia for from about less than 1 to about 10 seconds and preferably about less than 1 to about 6 seconds reduce further the substantially reduced odor of formaldehyde so that such odor is no longer readily apparent. To gain such further treatment, placement of the water treatment means at a point away from the material exit, so that the material will remain in the enclosed chamber for a time after water treatment, has been found to be a convenient method of achieving this end. Alternatively, the further gaseous ammonia treatment may be accomplished in a separate chamber.

Where additional ammonia treatment is desired within the chamber after the water treatment step, it might be desirable to maintain a nip roll doctor blade or similarly functioning means immediately after the water treatment means to decrease the amount of water maintained on the material when undergoing the additional ammonia cure. Such means have been found to be effective but are not necessary to the operation of the instant process.

Thereafter, the wetted material which contains about 10 to about 60 percent by weight of moisture pick-up is preferably oxidized or scoured, or washed to remove unpolymerized materials and the like. Where the present invention is carried out on yard goods using mill apparatus, this scouring operation may be effected using any of the conventional scouring, and the like. The scouring may be conveniently carried out using, an aqueous soap solution contaning small amounts of sodium carbonate, perborate, or peroxide and synthetic detergents. Preferably this scouring is carried out immdiately after the step of contacting the material with water.

Alternatively, the wetted material can be batched in rolls or in trucks and held for extended periods. When so handled, i.e., batched, the material does not develop significant formaldehyde odors nor does a significant exotherm develop. Thus, following the water wetting step of this process, the material is essentially completely processed, except for the normal and conventional scouring, etc. treatments and the flame retardant character is durably imparted thereto. Since in many mills the scouring and other final operations are carried out at points remote from the impregnation drying and curing operations, it is usual in this industry to batch the polymerized or cured materials to the area where the scouring and other finishing operations are carried out. Since hours or days may elapse, it can be seen that the process of this invention provides an efficient and economical means for preventing the deterioration of the flame retardant treatment prior to finishing the material.

The scouring step may be followed by conventional washing and drying operations and thereafter the dried treated material may be subjected to any normal finishing operation such as sanforizing, calendering, and the like.

The flame retardant cellulose-containing materials treated in accordance with the procedures set forth above have been found to be durably flame retardant, even after 50 or more home laundering and drying cycles. Additionally, such materials are substantially free from dust and have a tear resistance, tensile strength, and hand which are substantially unchanged from those of untreated materials.

The process of this invention is readily adaptable to modern high speed commercial textile processing equipment. Substantial savings of time and of consumption of ammonia gas, in the range of about 100 to 200 percent, are effected by this improved process. Additionally, the present process prevents the deterioration of the flame retardant character imparted to the material which may occur between the curing step and the scouring and other finishing steps.

Examples III and V through X illustrate the process of the present invention. In these examples, as well as in the above specification and the claims hereinfter set out, parts and percentages are by weight and temperatures are given in degrees Fahrenheit, unless otherwise specified. The durability of the flame retardancies reported by accelerated boil test and the 50 home washes test were determined in accordance with the procedure of the United States Department of Commerce test procedure No. DOC FF-3-71.

EXAMPLE I

A condensed reaction product of a poly(hydroxyorgano) phosphonium cation with a nitrogen containing compound was prepared by reacting 3,536 grams of 75% aqueous tetrakis(hydroxymethyl) phosphonium sulfate with 273 grams of urea in 351 grams of water for one hour at 100° Centigrade.

A pad bath was prepared containing 1,000 grams of the aforesaid condensed reaction product [being equivalent to the condensed reaction product of 850 grams of 75% aqueous tetrakis (hydroxymethyl) phosphonium sulfate, 66 grams od urea and 84 grams of water] together with 58 grams of $Na_2HPO_4$, 50 grams of 50% aqueous NaOH and 930 grams of water. The pH of the bath was 6.7 and it contained 26% equivalent tetrakis(-hydroxymethyl) cation.

Samples of 5 oz. cotton flannel sheeting were impregnated by passing them through the pad bath and thereafter through squeeze rolls to give a wet pick-up of approximately 110 percent. The thus impregnated samples were dried in a 250° F. oven for varying time periods and then, within about 20 seconds, exposed in an enclosed cabinet for about 10 seconds to an atmosphere containing 90% by volume gaseous ammonia and 10 percent by volume of air. The samples were sprayed with water and exposed to an additional atmosphere containing 80% by volume ammonia gas and 20% by volume of air for about 5 seconds. The thus treated samples were thereafter subjected to the usual oxidation, washing and drying steps, by impregnating the sample with 5% $H_2O_2$ for 1 minute, rinsing with hot (160° F.) water and drying on heated, exposed drying cannisters at 300° F. for 2 minutes.

The dried samples were then subjected to U.S. Department of Commerce test procedure No. DOC FF-3-71 with the exception that the samples were given only 25 home washing and drying cycles rather than the specified 50 hour washing and drying cycles. The results are as indicated in Table I. As can be seen, the samples which were dried for extended periods of time after impregnation burned when subjected to the test procedure.

TABLE 1

| | Precondensate | | |
|---|---|---|---|
| Sample | A | B | C |
| % THPOH | 26 | 26 | 26 |
| % Wet Pickup | 114 | 109 | 112 |
| Drying time (min.) | 1.5 | 15 | 30 |
| % Resin Add-On | 21 | 18 | 17 |
| Char Length (in.) | 2.2 | Burn | Burn |

EXAMPLE II

A pad bath was prepared containing 1,000 grams of poly (hydroxyorgano) phosphonium cation [being a mixture of 850 grams of tetrakis(hydroxymethyl) phosphonium sulfate with 150 grams of water] together with 58 grams of $Na_2HPO_4$, 50 grams of 50% aqueous NaOH and 930 grams of water. The pH of the bath was 6.7 and it contained 26% equivalent tetrakis(hydroxymethyl) cation.

Samples A–C were subjected to the same process under the same conditions as Example I and thereafter tested in accord with Example I with the results as shown in Table II.

TABLE II

| | Non-reacted phosphonium salt | | |
|---|---|---|---|
| Sample | A | B | C |
| % THPOH | 26 | 26 | 26 |
| % Wet Pickup | 111 | 110 | 110 |
| Drying time (min.) | 1.5 | 15 | 30 |
| % Resin Add-On | 19 | 3 | 0 |
| Char Length (in.) | Burn | Burn | Burn |

As can be seen each of the samples burned when subjected to the test procedure.

EXAMPLE III

A pad bath was prepared containing 1,000 grams of a poly(hydroxyorgano) phosphonium cation [being a mixture of 850 grams of tetrakis(hydroxymethyl) phosphonium sulfate with 66 grams of urea and 84 grams of water] together with 58 grams of $Na_2HPO_4$, 50 grams of 50% aqueous NaOH and 930 grams of water. The pH of the bath was 6.7 and it contained 26% equivalent tetrakis(hydroxymethyl) cation.

Samples A–C were subjected to the same process under the same conditions as Example I and therefore tested in accord with Example I with the results as shown in Table III. As can be seen even with extended periods after impregnation, the samples did not burn when subjected to the test procedure.

TABLE III

| | Phosphonium Salt/Urea In Situ | | |
|---|---|---|---|
| Sample | A | B | C |
| % THPOH | 26 | 26 | 26 |
| % Wet Pickup | 115 | 111 | 111 |
| Drying time (min.) | 1.5 | 15 | 30 |
| % Resin Add-On | 21 | 18 | 19 |
| Char Length (in.) | 1.9 | 2.0 | 2.1 |

EXAMPLES IV–X

For Examples IV–X, pad baths were prepared as in Example III but the urea levels were varied in mol ratio of urea:THPOH from 0.33:1.0 to 1.0:1.0 Disodium phosphate and sodium hydroxide mol ratios to THPOH were maintained at 0.13:1.0 and 0.20:1.0 respectively. Cotton flannel was padded with the various pad baths, squeezed to about 110% wet pick-up, dried for about 30 seconds at 300° F., exposed to a 90% ammonia gas atmosphere for 10 secs., sprayed with water and subsequently re-exposured to ammonia gas at 50% concentration for about 5 secs. The samples were then oxidized, rinsed and dried in accord with Example III. Example IV represents a pre-condensed control which was prepared in accord with Example I. The dried samples were then subjected to DOC FF-3-71 test procedure.

Table IV summarizes the results obtained. The efficiency increases slightly with increasing urea levels, but durability to home laudering decreases above 0.7 mols urea:mol THPOH. The hand was also found to become stiff above the aforesaid mole ratio of urea. The results of 0.33, 0.50, 0.60 and 0.70 mols urea:mol THPOH were equivalent to those obtained with the precondensate control as to durability, but produced a softer hand.

TABLE IV

| Example | Precondensed Control | | | | | | |
|---|---|---|---|---|---|---|---|
| No. | 4 | 5 | 6 | 7 | 8 | 9 | 10 |
| % THPOH | 28 | 28 | 28 | 28 | 28 | 28 | 28 |
| Moles Urea per mole THPOH | .33 | .33 | .50 | .60 | .70 | .80 | 1.0 |
| Final % Add-On | 24 | 23 | 23 | 23 | 23 | 23 | 24 |
| Char Length (in.) | 2.7 | 3.2 | 2.9 | 3.2 | 2.6 | Burn | 4.5 |
| Hand | Stiff | Good | Good | Good | Good | Sl Stiff | Sl Stiff |

EXAMPLE XI–XIV

A pad having a pH of 6.7 was prepared as in Example III, having a THPOH content of 28% and mol ratios of other reactants as shown below.

Urea:THP:0.38:1.0

$Na_2HPO_4$:THP:0.13:1.0

NaOH:THP:0.20:1.0

Samples of cotton flannel were padded at various intervals of time to determine the effect of bath age. Drying, curing, oxidizing and rinsing were carried out as in Example III. The results were as shown in Table V.

TABLE V

| | | | | |
|---|---|---|---|---|
| Bath Age, hrs. | 0 | 1 | 4 | 24 |
| % Resin Add-On | 25 | 26 | 26 | 26 |
| % Efficiency | 72 | 75 | 75 | 74 |
| FF-3-71 50 H.W. | | ←Pass→ | | |
| Hand | | ←Soft→ | | |

Thus, the retention of the soft hand indicates that the THPS-urea reaction does not take place in the pad bath, but on the fabric and within the cotton fiber during drying.

What is claimed:

1. A process for rendering cellulosic-containing materials durably flame retardant comprising:
   a. impregnating a textile material with a poly (hydroxyorgano) phosphonium cation containing solution, having a pH of from about 2 to about 9, containing from about 10 to about 40 percent by weight of poly(hydroxyorgano) phosphonium cation, and contiguously therewith impregnating said textile material with a nitrogen containing compound selected from amino function containing organic materials, amido function containing organic materials, and mixtures thereof
   b. drying the impregnated material, preferably under relatively mild conditions, to a moisture content of from about 0 to about 8 percent by weight;
   c. aerating the dried material by directing a current of air through the dried material;
   d. exposing the aerated material in an enclosed chamber for a period of at least about 5 seconds but less than about 60 seconds to an atmosphere containing at least about 50 percent by volume of gaseous ammonia to cure the phosphorus containing resin in and on the material;
   e. contacting the material with water to render the material durably flame retardant.

2. The process of claim 1 wherein at least one of said nitrogen containing compounds is selected from the group consisting of ureas, melamines, guanidines, substituted ureas, and the reaction product of amino and amido function containing organic materials with aldehydes.

3. The process of claim 2 wherein said nitrogen containing compound is urea.

4. The process of claim 1 wherein a basic catalyst agent is present in the impregnating solution.

5. The process of claim 1 wherein said cation containing solution has a pH of from about 4.0 to about 8.1.

6. The process of claim 1 wherein said water treatment step (e) occurs within the enclosed chamber of step (d).

7. The process of claim 1 wherein said water contacted material is further exposed to an ammonia atmosphere containing at least about 50 percent by volume of gaseous ammonia for from about 1 to about 10 seconds within the enclosed chamber of step (d).

8. The process of claim 7 wherein water treatment step (e) and the additional ammonia atmosphere exposure step occur within the enclosed chamber of step (d).

9. The process of claim 7 wherein water treatment step (e) and the additional ammonia atmosphere exposure step occur within a separate enclosed chamber from that of step (d).

10. The process of claim 1 wherein water is sprayed on the material in water treatment step (d).

11. The process of claim 1 wherein the material is passed through a trough of water in water treatment step (d).

12. The process of claim 11 wherein the material is squeezed after passing through said trough.

13. The process of claim 1 wherein the material is water treated by means of a kiss roll in water treatment step (d).

14. The process of claim 13 wherein water pick-up is regulated by a doctor blade.

15. The process of claim 1 wherein said cellulosic material is selected from the group consisting of cotton, rayon, paper, jute, ramie, wood, and mixtures and blends thereof.

16. The process of claim 15 wherein said cellulosic material is blended with proteinaceous fibers, synthetic fibers and mixtures thereof.

17. The process of claim 16 wherein said proteinaceous fiber is selected from the group consisting of wool, mohair, alpaca and mixtures thereof.

18. The process of claim 16 wherein said synthetic fiber is selected from the group consisting of polyester, nylon, acrylics, acetate and mixtures thereof.

19. The process of claim 1 wherein said poly(hydroxyorgano) phosphonium cation is prepared by reacting an aqueous solution of poly(hydroxyorgano) phosphonium salt with up to an equivalent quantity of a base.

20. The process of claim 19 wherein said poly(hydroxyorgano) phosphonium salt is selected from the group consisting of halides, sulfates, acetates, phosphates, carboxylates, oxalates, lactates, formates, sulfonates and mixtures thereof.

21. The process of claim 20 wherein said salt is tetrakis(hydroxymethyl) phosphonium sulfate.

22. The process of claim 4 wherein said basic catalyst agent is in the textile treating solution in an amount within the range of about 0.5 to about 20% by weight.

23. The process of claim 1 wherein said basic catalyst agent is selected from carbonates, bicarbonates, acetates, phosphates and metasilicate.

24. The process of claim 23 wherein said agent is sodium hypophosphate.

25. The process of claim 2 wherein said amino function containing organic materials are melamines.

* * * * *